US006659145B1

(12) United States Patent
Reif et al.

(10) Patent No.: US 6,659,145 B1
(45) Date of Patent: Dec. 9, 2003

(54) TOOTHPASTE TUBE FILLING OR REPLENISHMENT UNIT

(76) Inventors: Michael Y. Reif, 312 Calle, San Miguel, P.O. Box 156 - 1250, Escazu (CR); Robert S. Reif, 25 W. Portola Blvd., Los Altos, CA (US) 94022; Nicholas A. Rodgers, 40 Colina del Mirador, P.O. Box 28 - 1250, Escazu (CR)

( * ) Notice: Subject to any disclaimer, the term of this patent is extended or adjusted under 35 U.S.C. 154(b) by 59 days.

(21) Appl. No.: 10/051,076

(22) Filed: Jan. 22, 2002

(51) Int. Cl.[7] ..... B65B 3/16

(52) U.S. Cl. ..... 141/319; 141/376; 141/379; 141/384

(58) Field of Search ..... 141/319, 363, 141/364, 375, 376, 379, 380, 383, 384; 222/539; 285/32, 390, 417

(56) References Cited

U.S. PATENT DOCUMENTS

| | | | |
|---|---|---|---|
| 3,261,381 | A | 7/1966 | Roach |
| 3,266,533 | A | 8/1966 | McHale |
| 3,595,279 | A | 7/1971 | Jaffe |
| 3,620,267 | A | 11/1971 | Seablom |
| 5,000,236 | A | 3/1991 | Jemison |
| 5,533,553 | A | 7/1996 | Vesborg |
| 5,884,678 | A | 3/1999 | Chudy |
| 5,964,260 | A | 10/1999 | Chudy |

*Primary Examiner*—Gene Mancene
*Assistant Examiner*—Peter deVore
(74) *Attorney, Agent, or Firm*—Dowell & Dowell, P.C.

(57) ABSTRACT

A filling or replenishment unit is mountable on a first toothpaste tube used for travel 'travel tube' and may be moved to extended position to establish communication with a second tube to allow refilling of the first tube from the second.

19 Claims, 7 Drawing Sheets

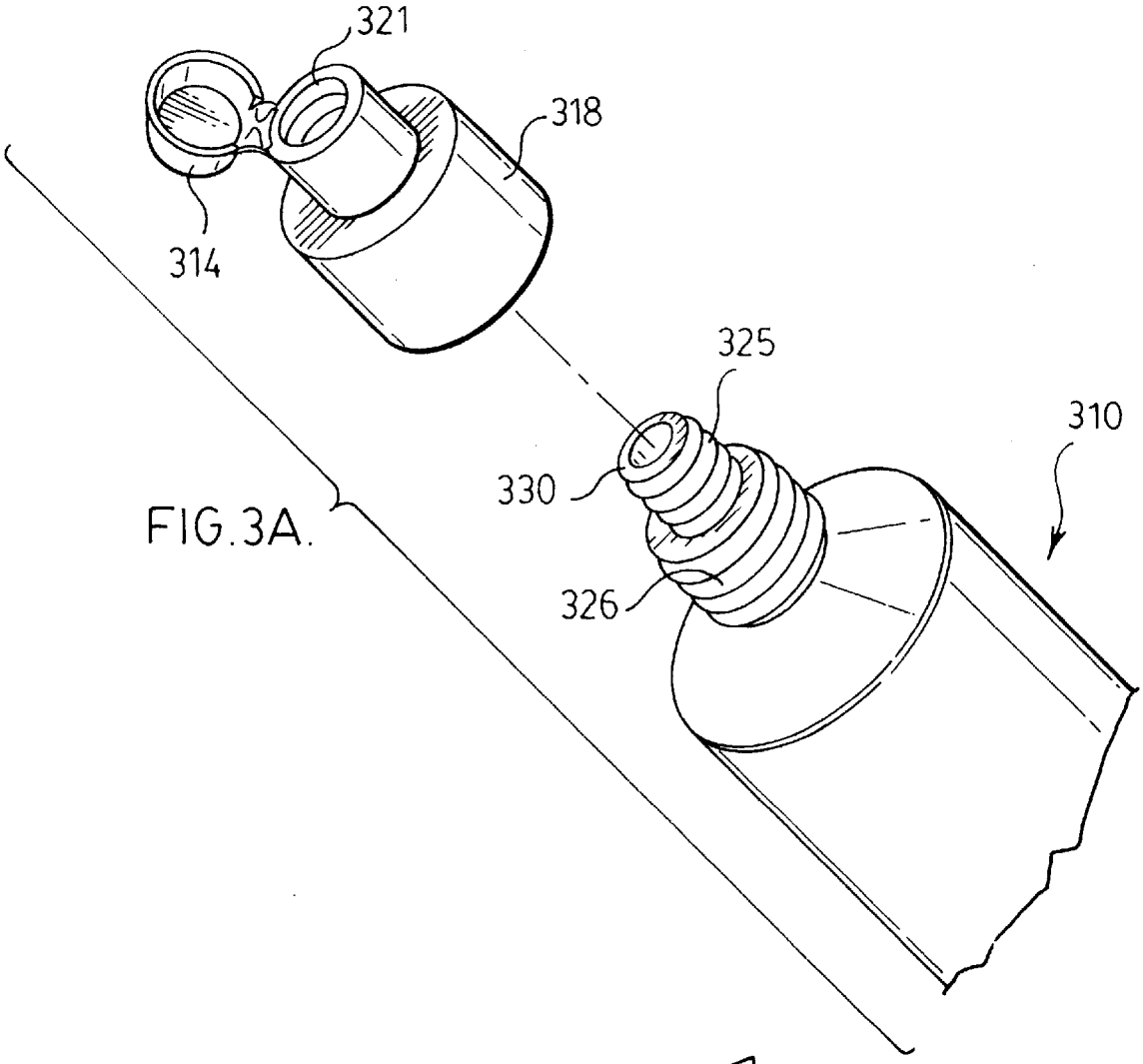
FIG.3A.
FIG. 3.
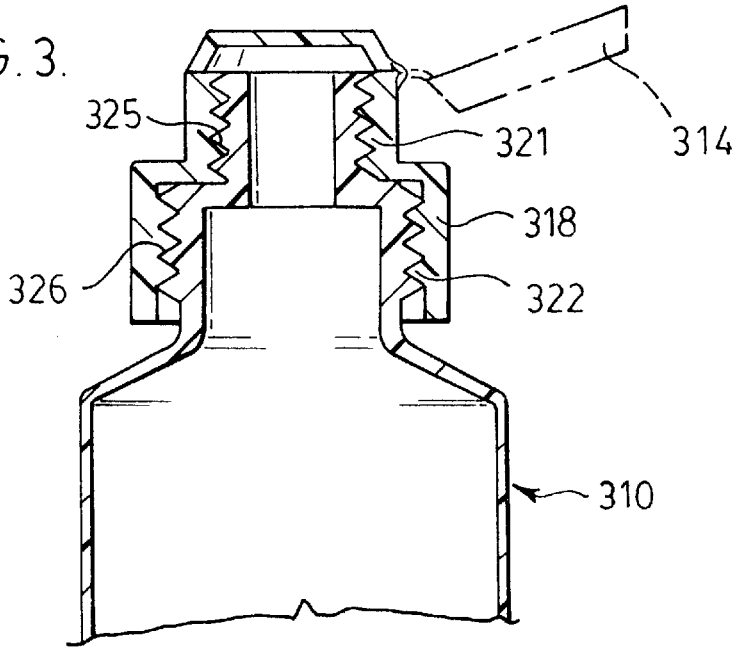

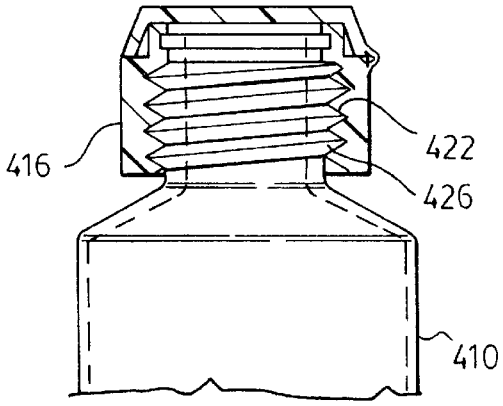
FIG. 4.
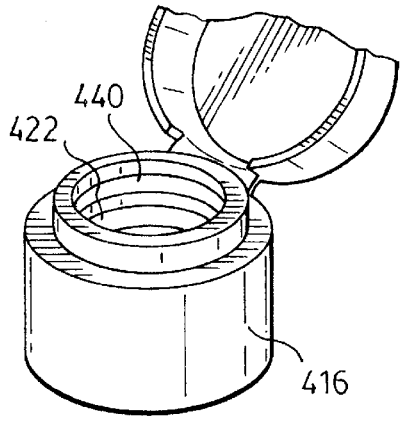
FIG. 4A.
FIG. 4B.
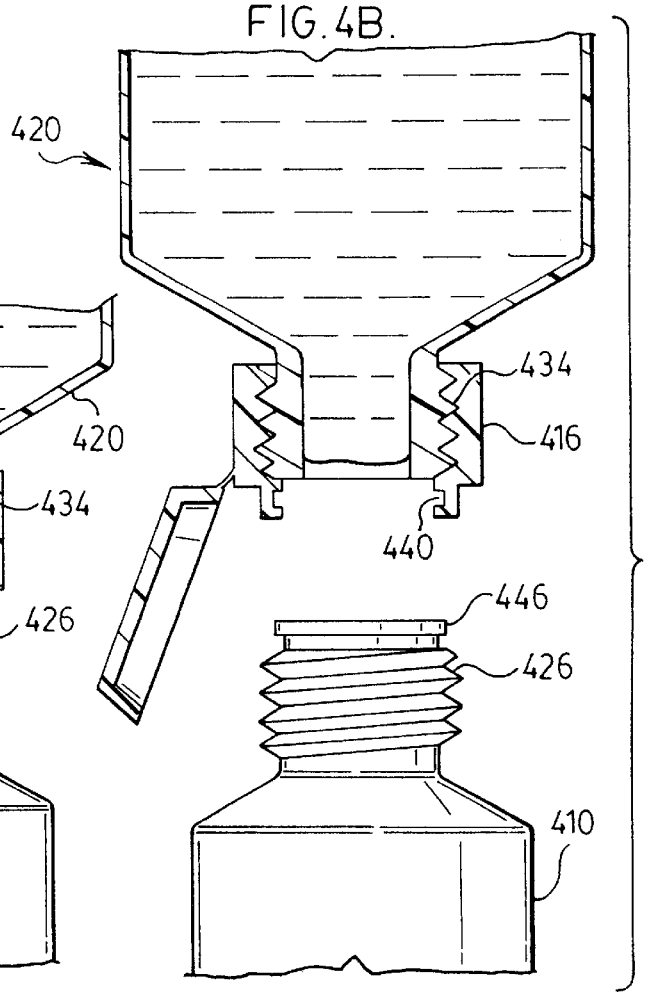
FIG. 4C.
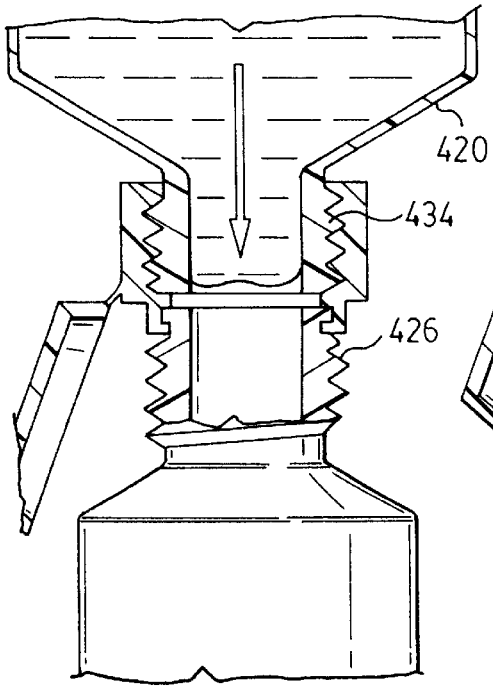

TOOTHPASTE TUBE FILLING OR REPLENISHMENT UNIT

This invention relates to a toothpaste tube filling or replenishment unit mountable on the tube itself Thus, the tube, referred to herein as a travel tube, is equipped to carry a sleeve designed to allow the travel tube to be filled or replenished from another tube, called herein the home tube. Thus travellers may carry the travel tube and fill it or partially fill it or refill it from a home tube. The home tube may carry the traveller's favorite brand of toothpaste.

By 'filling' herein I include partial as well as complete filling and filling for the first or another time.

The filling unit is designed to be neatly carried on the travel tube. The travel tube may thus be filled or replenished by any other tube which has a compatible thread on its spout. Moreover the unit has means, preferably a plastic cap which squeezes on or fastens on the open end or spout of the travel tube when the travel tube is not in use, to effect closure of the travel tube.

In accord with the invention the filling or replenishment unit ('unit' hereafter) comprises a sleeve with interior threading shaped to threadedly receive a home tube exterior threaded spout. Means are provided for storing the sleeve on the travel tube when not in use; and when desired for filling or replenishment for placing the sleeve in an attitude (extended position) to receive the home tube screwed into the sleeve with the home tube passage communicating with the travel tube passage for filling or replenishment of the latter. The home tube may be unscrewed when the travel tube is filled or replenished, and the sleeve replaced in storage position or retracted position.

Preferably means by preferably a cap attached to the sleeve is available to close the travel tube when the sleeve is not in use.

In accord with the invention, unit comprising a sleeve designed to be carried on the travel tube is provided with exposable interior threads to receive the end of the home tube screwed thereto. When the home tube is threaded into the sleeve it will be noted that preferably the spout edge of the home tube can be made to abut the spout edge of the travel tube to prevent migration of extra toothpaste among the threads of the sleeve or the home tube.

In a first preferred form of the invention the travel tube mounts a sleeve having retracted and extended positions and internal threading which can mesh with exterior threading on the outside of the travel tube spout as well as with exterior threading on the home tube spout. Thus the sleeve, mounted on the travel tube when not in use may, for filling or replenishment, be partially unscrewed from the travel tube to expose an extent of its internal threads. The home tube may then be screwed in "docked" in the exposed sleeve threads so the home tube may be squeezed for filling or replenishment of the travel tube. When filling or replenishment is completed the home tube may be unscrewed from the sleeve and the sleeve screwed back into retracted position on the travel tube. The sleeve may be dimensioned so that the ends of the travel tube spout, screwed into one sleeve end, and of the home tube spout, screwed into the other sleeve end, may abut and prevent the escape of toothpaste into the internal or external threadings. When the sleeve is again retracted, means may be provided attached to the sleeve to close the travel tube spout.

In a second preferred form of the invention, the travel tube mounts a sleeve, having means for mechanical coupling with the travel tube in both a retracted and extended position. The sleeve may be manually moved to one position or the other. In the extended position the sleeve exposes internal threading to allow screwing in of the spout of the home tube. The sleeve may be dimensioned so that the end of the screwed in home tube spout abuts the end of the home tube spout to minimize escape of toothpaste in the threadings.

In a third preferred form of the invention the spout of the travel tube has an inner extent with exterior threading of a given external diameter, and an outward threading extent of smaller exterior diameter. A sleeve has complementary dual diameter internal threading so that it may be stored on and screwed on and off the travel tube. It is understood that both large and small diameter threadings have the same lead and be coaxial.

With such preferred form, when it is desired to fill or replenish the travel tube, the sleeve may be unscrewed from the travel tube and reversed then (a) screwed with its large threading on the home tube then (b) screwed with its small diameter on the small diameter exterior threading of the travel tube. (Note that steps (a) and (b) may be reversed in order.) The travel tube is then filled or replenished by squeezing the home tube. The sleeve may be dimensioned so that during filling or replenishment the travel tube spout edge rests on the spout end of the home tube to provide a near seal to inhibit the escape of toothpaste into the threadings.

When the sleeve has been unscrewed from the home tube and screwed to the travel position on the travel tube cap, means preferably provided on the sleeve may be used to cap the open end of the travel tube.

In a fourth preferred form for the invention the travel tube sleeve has internal threading to (c) to threadably receive a home tube external thread and a snap flange which cooperates with the travel tube spout to (d) mount the sleeve in retracted and external positions. In external position the sleeve exposes its internal threading facing the home tube to receive the latter screwed therein. In retracted position a cap preferably on the sleeve may be used to close the sleeve spout.

In all embodiments, during filling or replenishment there is a defined conduit from the inside of its home tube to the inside of the travel tube. Preferably this conduit will be smooth for easy flow of toothpaste and home and travel tubes will preferably abut during filling or replenishment to avoid escape of toothpaste into the threaded extents.

Preferably the sleeve in each embodiment is provided with a means such as a cap operable in a way well known to those skilled in the art to close the travel tube spout when the sleeve is stowed on the travel tube.

All embodiments preferably provide a sleeve which stows neatly on the travel tube when not in use, and, which in use provides a conduit between the inside of the home tube and the inside of the travel tube for filling or replenishment of the contents of the latter.

In drawings which illustrate preferred embodiments of the invention:

FIG. 3 is a section of a travel tube with a sleeve in retracted position thereon.

FIG. 3A is an exploded perspective of the travel tube and sleeve of FIG. 3.

FIG. 4 is the section of a travel tube and another sleeve in retracted position.

FIG. 4A is a perspective of the sleeve shown in FIG. 4.

FIG. 4B is a travel tube and the sleeve portion (of FIG. 4) ready to couple to the home tube.

FIG. 4C is a section showing the travel tube of FIG. 4 being replenished.

The toothpaste tubes have bodies of conventional design, typically a metal compressible tube and a plastic tube end with spout and threading.

Figure 1:
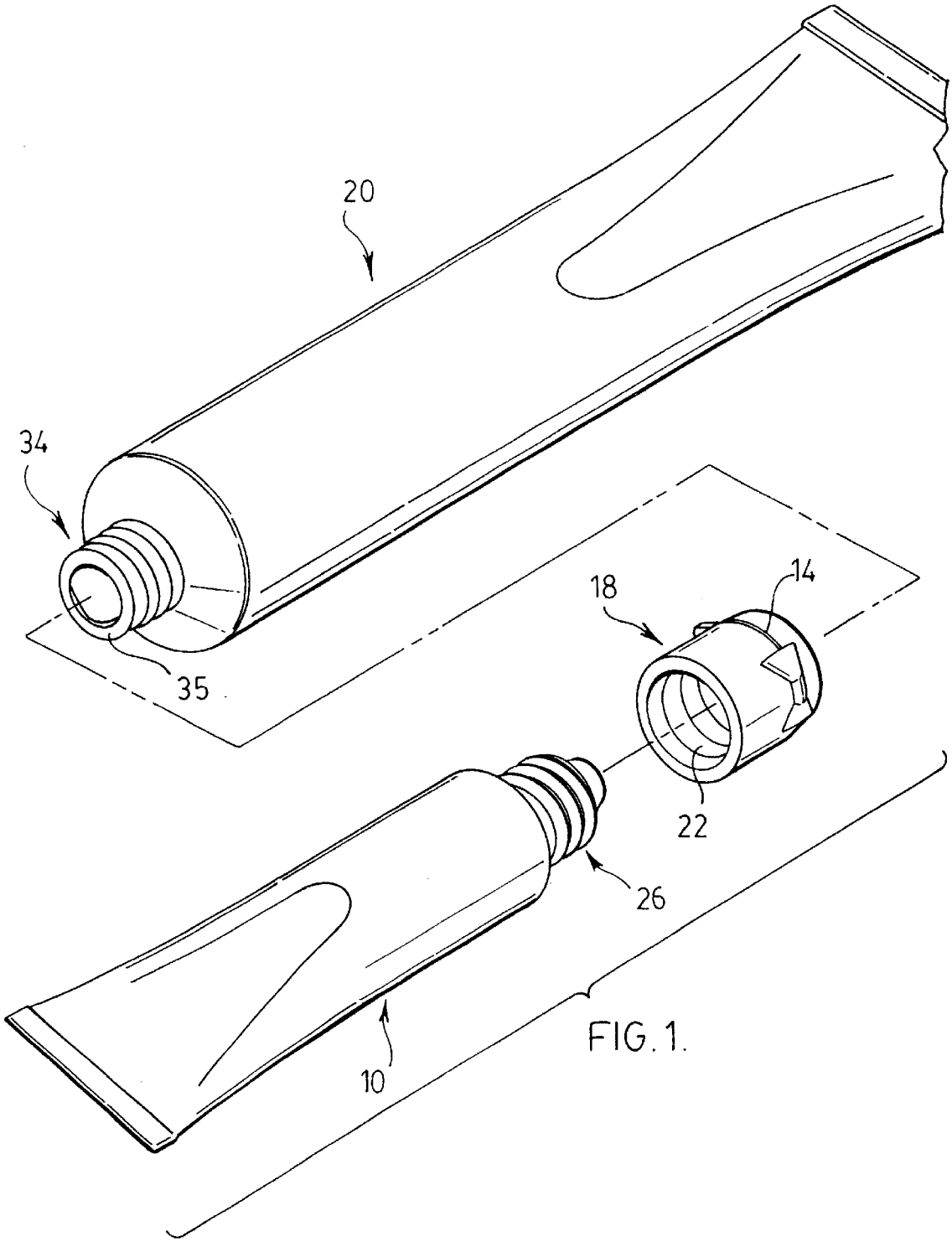
FIG. 1 is an exploded view of a first preferred form of the invention showing travel tube, sleeve and home tube.
Figure 1A:
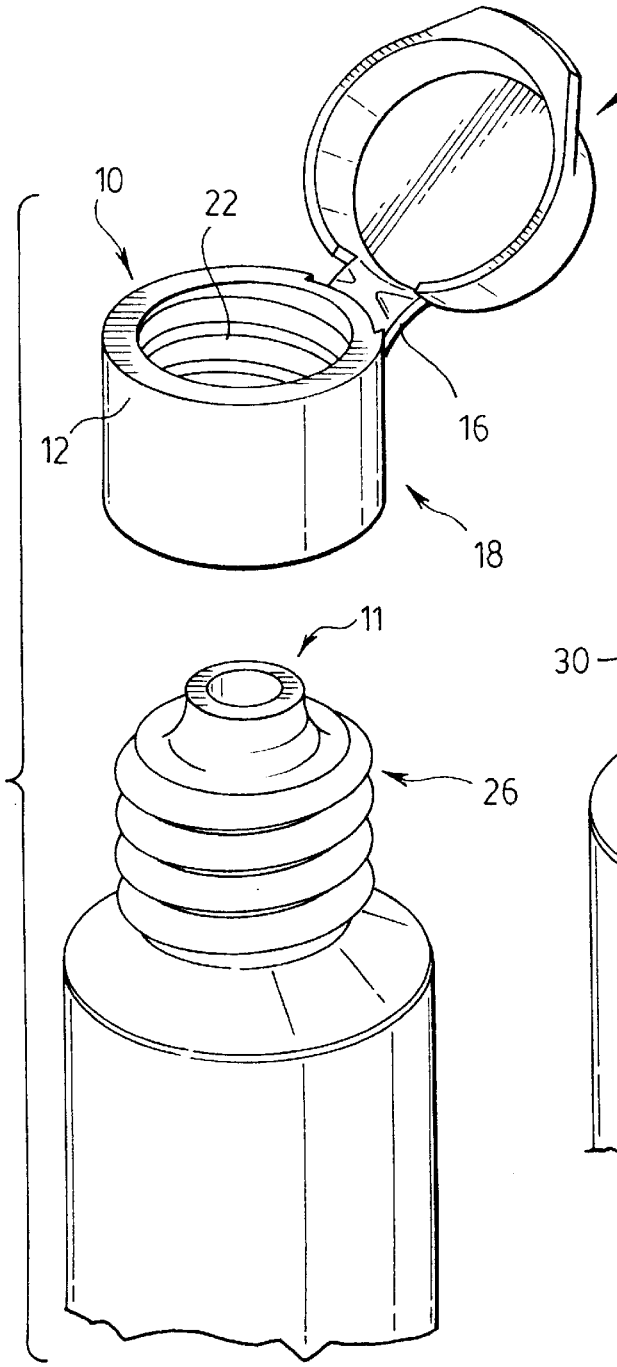
FIG. 1A is a perspective view of a travel tube and detached sleeve of FIG. 1.
Figure 1B:
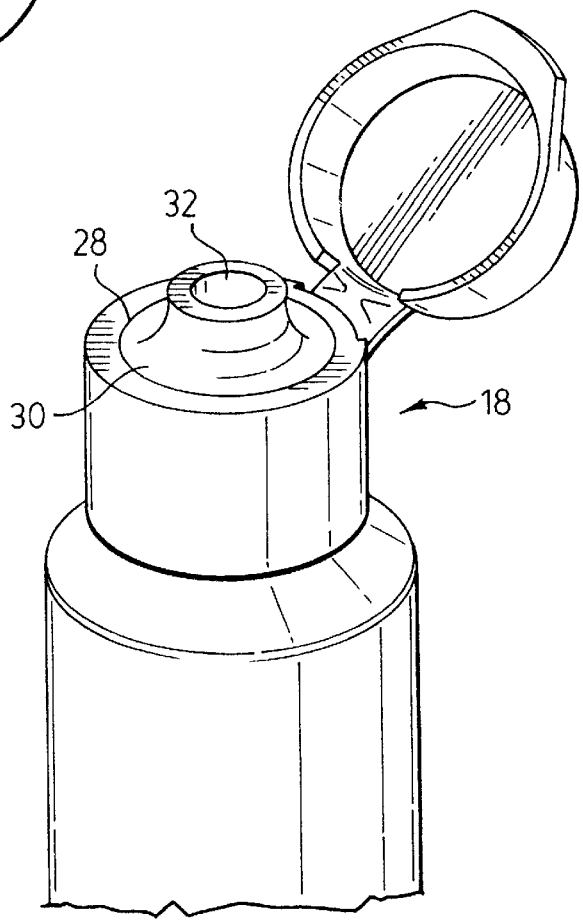
FIG. 1B is a perspective view of a travel tube mounting a retracted sleeve of FIG. 1.
Figure 1C:
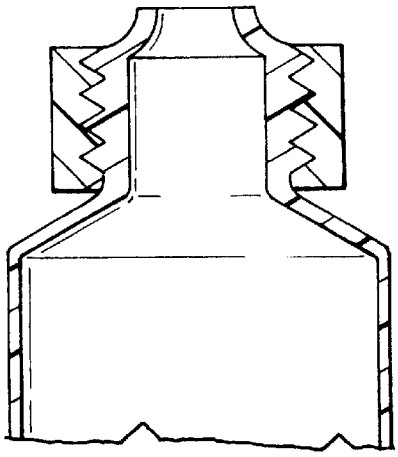
FIG. 1C is a vertical section with a sleeve of FIG. 1 mounted thereon in retracted position.
Figure 1D:
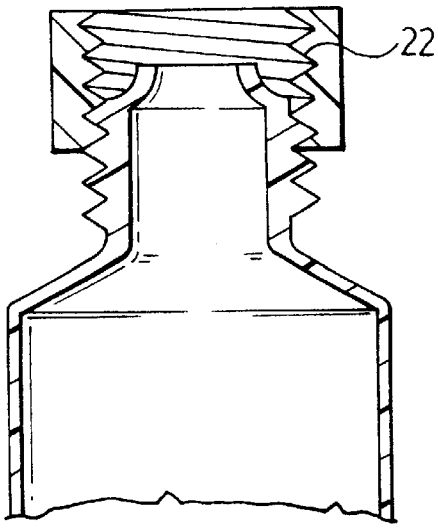
FIG. 1D is a vertical section with the sleeve of FIG. 1 wound to extended position.
Figure 1E:
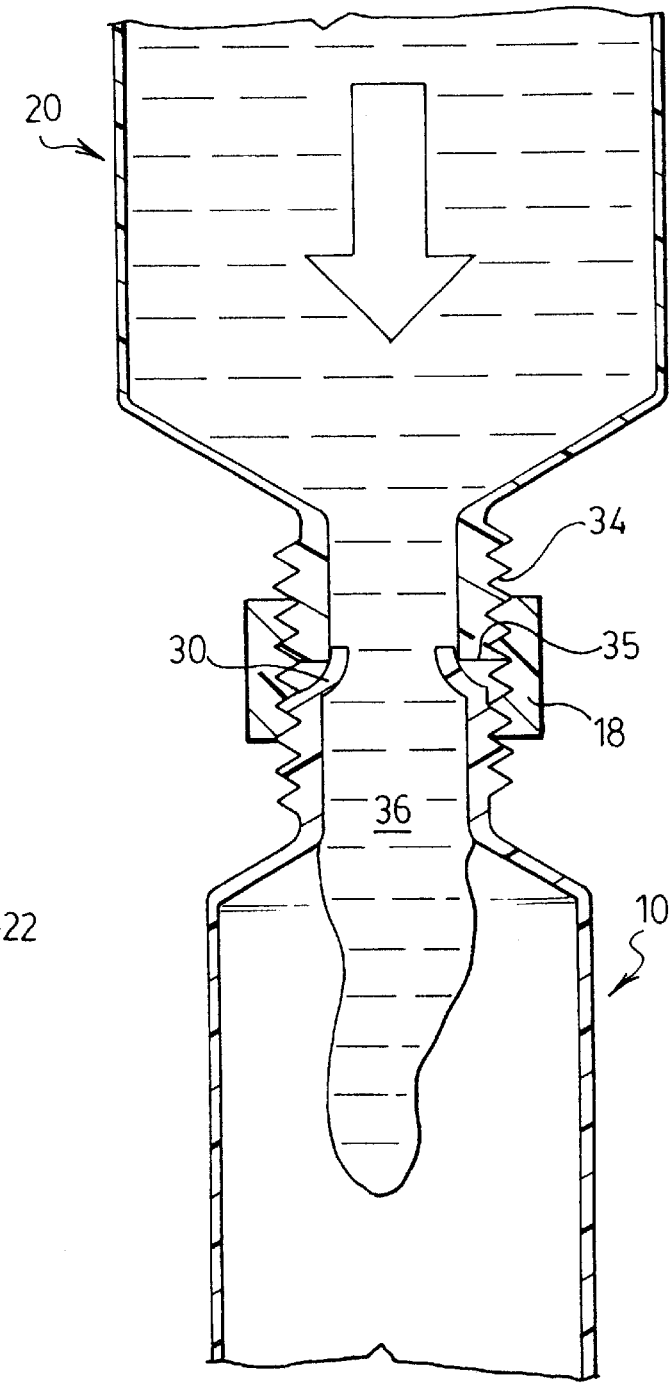
FIG. 1E is a vertical section of a home tube filling or replenishing the travel tube of FIGS. 1–1D.

FIGS. 1 to 1E show the first of four preferred embodiments.

A travel tube 10 is assumed to have the same lead pitch and size of threading 26 as the basic threading 34 of the home tube 20. The travel tube 10 has a sleeve 18 with sides outward of the end of the threading to make, in retracted position, a snap fit with travel tube cap 14 on flexible arm 16. Other closing means may be provided in other embodiments; most suitable caps known to those skilled in the art will work with the invention features if the caps are mounted on the sleeves.

Sleeve 18 has internal threading 22 to screw smoothly on travel tube exterior threading 26 or on outer threading 34.

Flange 28 on the outer rim of sleeve 18 seals against a surface 30 adjacent the spout opening 32 in the retracted attitude of the sleeve. Flange 28 acts to prevent the escape of toothpaste into the threading when the sleeve is retracted . Members may be dimensioned so that in the filling or replenishment position edge 35 of the home tube spout bears on surface 30 of the travel tube to inhibit the escape of toothpaste among the threadings 22. The sleeve 18 is shown in extended position in FIGS. 1D and 1E to expose a length of inner threading to threadedly receive the outer threading 34 of the home tube 20.

The home tube 20 in the position of FIG. 1E may then be squeezed to replenish the travel tube 10 with toothpaste 36.

After which the home tube is removed and capped with a cap (not shown), the sleeve 18 is screwed back to retracted position on the travel tube and the travel tube cap 14 is closed.

Figure 2:
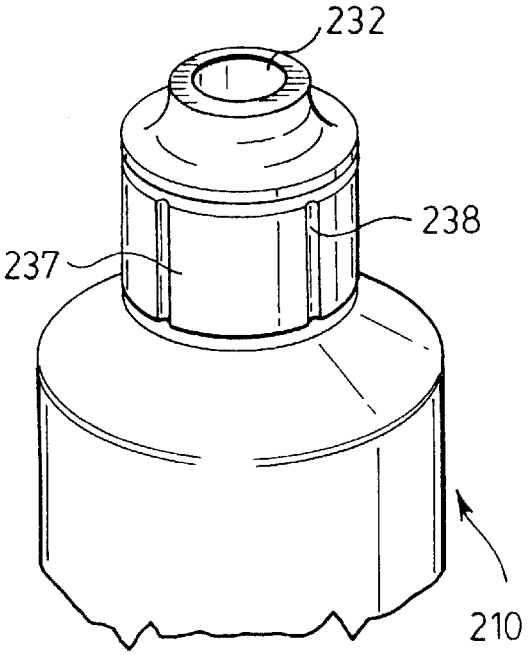
FIG. 2 shows the top of a travel tube with part of an alternate sleeve removed.
Figure 2B:
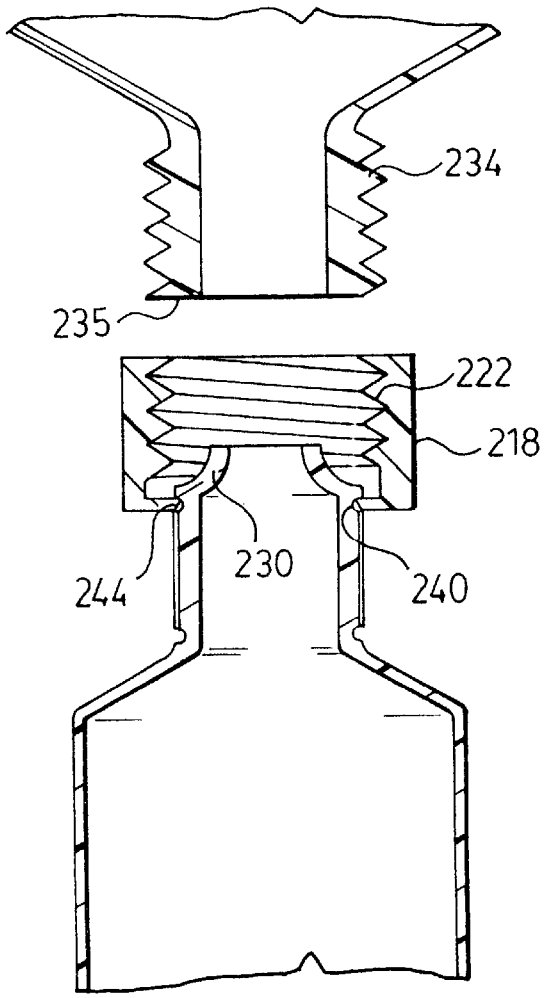
FIG. 2B shows a section of the top of a travel tube with the sleeve of FIG. 2 in extended position and a home tube about to be screwed thereto. The travel tube cap is omitted in FIGS. 2–2B.
Figure 2A:
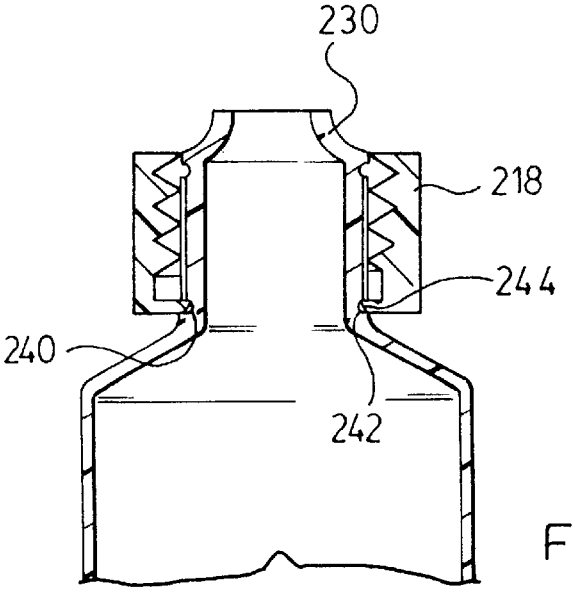
FIG. 2A shows a section of the top of a travel tube of FIG. 2 with the sleeve in retracted position.

In FIGS. 2 to 2B the second alternative embodiment is shown. (FIG. 2 omits sleeve 218 for clarity.) The travel tube provides surface 237 with vertical grooves 238 below the spout 232, the grooves terminating in upper and lower stop recesses 240 and 242 respectively. A sleeve 218 is provided with resilient dogs 244 which run in the vertical grooves 238 between upper and lower stop recesses 240. The sleeve 218 is provided with inner threading 222 complementary to the outer threading 234 on home tube 220. Thus the home tube may be screwed into the internal threading 222 to fill or replenish the travel tube. During filling or replenishment members may be dimensioned so that travel tube spout edge 235 contacts spout surface 230 of the home tube to avoid the escape of toothpaste into the threadings. After which the home tube may be removed and capped, the sleeve 218 snapped to retracted position and the travel tube cap (not shown) replaced.

Figure 3B:
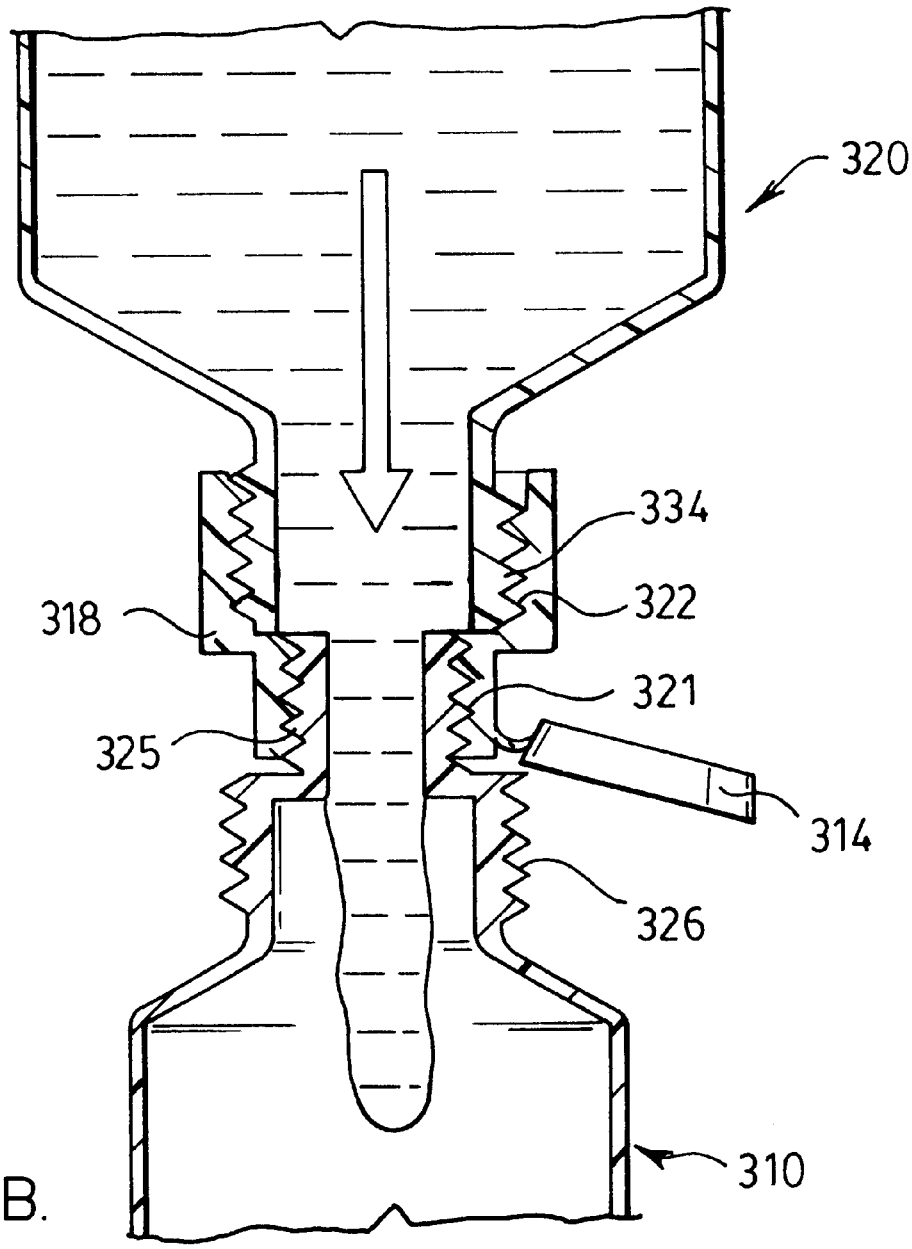
FIG. 3B is a section of a home tube filling or replenishing the travel tube of FIG. 3.

In FIGS. 3 to 3B the third preferred embodiment is provided showing a travel tube 310 with large exterior threading 326 inboard of small exterior threading 325. To operate both large and small threading must be coaxial and of equal pitch.

A sleeve 318 has internal threading 322 and internal threading 321 complementing respectively the large and small threading 326 and 325 on the travel tube so that sleeve 318 may be screwed in place on the travel tube when not in use as shown in FIG. 3. The sleeve 318 carries a cap 314 for snap closure of the travel tube spout in the retracted position of the sleeve as in the solid line position in FIG. 3. For filling or replenishment the sleeve 318 may be unscrewed and reversed and (a) have its smaller internal threads 322 screwed on the travel tube's spout small exterior threads 325 and (b) the home tube with threads 334 is screwed into the large threading 322 in the sleeve. Please note that steps (a) and (b) can be performed in reverse order.

No claim is made to the inner shaping of the home tube which may vary from manufacturer to manufacturer. FIGS. 1E, 2B, 3E and 4B show home tubes with inner tapering throats of varying dimensions. The tapering throat eases filling or replenishment but is not essential to this invention. After filling or replenishment the sleeve 318 is removed from home tube 320 and travel tube 310 (in either order) and reversed in direction to be screwed on the travel tube as shown in FIG. 3, the cap 314 fastening in any desired manner well known to those skilled in the art to close the travel tube spout.

In the fourth embodiment of the invention travel tube 410 is shown in FIGS. 4–4C where there is shown a sleeve 416 with internal threading 422 to screw on travel tube spout exterior threads 426. Filling or replenishment is provided by unscrewing the sleeve 416 from the travel tube external thread 426. The sleeve 416 is then (c) screwed onto the home tube threading 434 and (d) has its snap groove 440 snapped over the ridge 446, on the travel tube 416. (Note (c) and (d) can be done in reversed order.) The travel tube is then filled or replenished as shown in FIG. 4C by squeezing home tube 420. After filling or replenishment the sleeve 416 is snapped off the travel tube end and unscrewed from the home tube 420, reversed and stowed on the home tube as shown in FIG. 4. Both tubes are capped.

It is noted that a sleeve may be provided with a travel tube closure means such as a spout cap in all embodiments. It is noted that dimensions may be chosen so that home tube and travel tube surfaces abut during filling or replenishment to inhibit toothpaste flow on sleeve or spout threads.

It is noted that the design allows relatively smooth contours in the filling or replenishment conduits on travel and home tubes, see particularly FIG. 1E, FIG. 3B and FIG. 4C. A similar smooth contour, (not shown) may be found for the arrangement of FIGS. 2–2B.

We claim:

1. First toothpaste tube comprising:

a spout, a sleeve with internal threading shaped to threadedly receive another toothpaste tube exterior threaded spout, said sleeve being designed to assume a retracted and an extended position when mounted on said first tube, means for closing said first tube spout when said sleeve is in retracted position, in extended position exposing internal threading adapted to receive said other tube extension threaded spout, said reception of said other tube external threading providing a toothpaste supply conduit from said other tube to said first tube.

2. First toothpaste tube as claimed in claim 1, wherein a means mounted on said sleeve is movable to close the travel tube spout when said sleeve is in retracted position.

3. First toothpaste tube as claimed in claim 2, wherein in extended position of said sleeve and receiving said other tube external threading the surfaces on each of said travel first and other tubes may contact to inhibit the escape of toothpaste.

4. First toothpaste tube as claimed in claim 1, wherein said travel first tube and said other tube have spout ends and are dimensional so that said spout ends abut inside said sleeve.

5. First toothpaste tube as claimed in claim 4, wherein means mounted on said sleeve is movable to close the travel first tube spout when said sleeve is in retracted position.

6. First toothpaste tube as claimed in claim 1, wherein said sleeve having has an extended position reversed in direction relative to said retracted orientation, said sleeve when reversed from the retracted orientation exposing internal threading for receiving said home tube.

7. First toothpaste tube as claimed in claim 6, wherein means mounted on said sleeve is movable to close the travel first tube spout when said sleeve is in retracted position.

8. First toothpaste tube as claimed in claim 1, where said internally threaded sleeve is rotatable on a travel said first tube to extended position to threadedly receive the end of said other tube.

9. First toothpaste tube as claimed in claim 8, wherein means mounted on said sleeve is movable to close the travel first tube spout when said sleeve is in retracted position.

10. First toothpaste tube as claimed in claim 1, wherein said sleeve is slidable between extended and retracted positions and is releasably maintained in said extended position.

11. First toothpaste tube as claimed in claim 10, wherein means mounted on said sleeve is movable to close the travel first spout when said sleeve is in retracted position.

12. First toothpaste tube as claimed in claim 1, wherein means mounted on said sleeve is movable to close said travel first tube spout when said sleeve is in retracted position.

13. First toothpaste tube as claimed in claim 1, wherein in extended position of said sleeve and receiving said other tube external threading the surfaces on each of said travel first and other tubes may contact to inhibit the escape of toothpaste.

14. First toothpaste tube as claimed in claim 1, where said travel first tube has a spout with inwardly located large diameter external threading and outwardly located smaller diameter external threading, both threadings having the same lead and axis.

15. Method of employing the first toothpaste tube of claim 14 comprising:

unscrewing the sleeve from the travel first tube, reversing its direction, screwing the sleeve's small diameter internal threading onto the travel first tube's spout small diameter external threads, and before or after the preceding step, screwing the other tube spout external threading into the sleeve large internal threads.

16. The method as claimed in claim 15, wherein including the step of activating means mounted on said spout is movable to close the travel first tube spout when said sleeve is in retracted position.

17. First toothpaste tube, having a spout, a sleeve adapted to be placed in retracted or extended position relative to said spout, in extended position adapted to threadedly receive a second tube in a position that paste squeezed from said second tube will reach said first tube, means for closing said first tube with said sleeve in retracted position.

18. First toothpaste tube as claimed in claim 17, wherein said means for closing is located on said sleeve.

19. First toothpaste tube as claimed in claim 17, wherein in extended position said second tube is received in abutting relation to said first tube.

* * * * *